US010539016B2

(12) United States Patent
Su et al.

(10) Patent No.: US 10,539,016 B2
(45) Date of Patent: Jan. 21, 2020

(54) TUNNEL BORING MACHINE

(71) Applicant: XCMG-KAIGONG HEAVY INDUSTRY NANJING CO., LTD., Nanjing, Jiangsu (CN)

(72) Inventors: Yanqi Su, Jiangsu (CN); Shaohua Ding, Jiangsu (CN); Liutao Li, Jiangsu (CN)

(73) Assignee: XCMG-KAIGONG HEAVY INDUSTRY NANJING CO., LTD, Nanjing (CN)

( * ) Notice: Subject to any disclaimer, the term of this patent is extended or adjusted under 35 U.S.C. 154(b) by 0 days.

(21) Appl. No.: 15/991,261

(22) Filed: May 29, 2018

(65) Prior Publication Data

US 2019/0264563 A1 Aug. 29, 2019

(30) Foreign Application Priority Data

Feb. 26, 2018 (CN) ..... 2018 1 0159434

(51) Int. Cl.
*E21D 9/08* (2006.01)
*E21D 9/11* (2006.01)
*E21D 9/10* (2006.01)

(52) U.S. Cl.
CPC ..... *E21D 9/0874* (2016.01); *E21D 9/111* (2013.01); *E21D 9/0879* (2016.01); *E21D 9/1093* (2013.01)

(58) Field of Classification Search
CPC ..... E21D 9/0874; E21D 9/111; E21D 9/1093; E21D 9/0879

(Continued)

(56) References Cited

U.S. PATENT DOCUMENTS

RE24,965 E * 4/1961 Kirkpatrick ..... E21D 9/113 299/31
2,988,348 A * 6/1961 Robbins ..... E21D 9/1093 299/31

(Continued)

FOREIGN PATENT DOCUMENTS

CN 101949292 1/2011
CN 201802407 4/2011

(Continued)

OTHER PUBLICATIONS

SIPO, First Office Action for CN Application No. 201810159434, dated Feb. 28, 2019.

(Continued)

*Primary Examiner* — Benjamin F Fiorello
*Assistant Examiner* — Edwin J Toledo-Duran
(74) *Attorney, Agent, or Firm* — Hodgson Russ LLP

(57) ABSTRACT

A tunnel boring machine includes: a shield body; a cutterhead assembly, a first drive mechanism; a second drive mechanism; and a third dive mechanism. The cutterhead assembly includes a main cutterhead and a plurality of auxiliary cutterheads. The main cutterhead is rotatably arranged at a front side of the shield body and defines a soil chamber between the main cutterhead and the shield body, and is movable along an up-down direction. The plurality of auxiliary cutterheads are rotatably arranged in the soil chamber, and adjacent to a bottom of the shield body and arranged at left and right sides of a vertical central line of the main cutterhead. A rotation diameter of the main cutterhead is greater than a rotation diameter of the auxiliary cutterhead, and the rotation diameter of the main cutterhead is the same as a maximum width of the shield body.

14 Claims, 10 Drawing Sheets

(58) Field of Classification Search
USPC ..... 299/10, 55, 57, 58, 59, 60, 62; 405/138
See application file for complete search history.

(56) References Cited

U.S. PATENT DOCUMENTS 3,386,520 A * 6/1968 Clifton ..... E21D 9/113 175/230
3,428,363 A * 2/1969 Hoever ..... E21D 9/11 299/57
3,446,535 A * 5/1969 Lauber ..... E21D 9/1093 299/31
3,556,599 A * 1/1971 Fikse ..... E21D 9/124 299/11
3,612,609 A * 10/1971 Reuls ..... E02F 3/303 299/33
3,643,998 A * 2/1972 Williamson ..... E21D 9/116 299/31
3,748,680 A * 7/1973 Griffin ..... A47L 11/38 15/50.3
3,958,831 A * 5/1976 Nakashima ..... E21D 9/106 299/64
3,979,917 A * 9/1976 Crafton ..... E21D 9/10 405/138
4,185,873 A * 1/1980 Bohnes ..... E21D 9/1033 299/31
4,190,294 A * 2/1980 Fikse ..... E21D 9/1093 299/33
4,248,481 A * 2/1981 Stoltefuss ..... E21D 9/0875 299/33
4,494,617 A * 1/1985 Snyder ..... E21D 1/06 175/322
4,556,256 A * 12/1985 Follert ..... E02F 3/9231 299/11
4,804,295 A * 2/1989 Kondo ..... E21B 10/12 299/31
4,915,541 A * 4/1990 Thompson ..... E21D 9/093 405/141
5,110,188 A * 5/1992 Kawai ..... E21D 9/0879 299/10
5,284,403 A * 2/1994 Ilomaki ..... E21B 7/201 299/1.3
5,904,211 A * 5/1999 Friant ..... E21B 10/12 175/228
8,210,774 B1 * 7/2012 Vidovic ..... 175/62
9,039,330 B1 * 5/2015 Olson ..... E03F 3/06 405/184.5
2008/0024000 A1 * 1/2008 Moulin ..... E21D 9/003 299/1.05

FOREIGN PATENT DOCUMENTS

| | | |
|---|---|---|
| CN | 102261252 | 11/2011 |
| CN | 204060702 | 12/2014 |
| CN | 204312078 | 5/2015 |
| CN | 104929651 | 9/2015 |
| CN | 205805558 | 12/2016 |
| CN | 206397505 | 8/2017 |
| JP | 2011074752 | 4/2011 |

OTHER PUBLICATIONS

SIPO, Second Office Action for CN Application No. 201810159434.4, dated Sep. 27, 2019.

* cited by examiner

TUNNEL BORING MACHINE

CROSS-REFERENCE TO RELATED APPLICATION

This application claims priority to and benefits of Chinese Patent Application Serial No. 201810159434.4, filed with the State Intellectual Property Office of P. R. China on Feb. 26, 2018, the entire content of which is incorporated herein by reference.

FIELD

The present disclosure relates to the field of engineering machineries, and more particularly to a tunnel boring machine.

BACKGROUND

In recent years, due to increasingly serious traffic congestion in cities, subway projects are developed in more and more cities. Tunnel boring machines have a dominant position in construction of subway projects in cities and make up indispensable common techniques in construction of tunnels, owing to that the tunnel boring machines have small effects on environments and a wide range of application, and are suitable for constructions with large depth, high earth pressure and high water pressure, and low in costs.

Over the past thirty years, shield tunneling technologies developed at full speed with varied types of shields. Currently, the tunnel boring machines have circular, rectangular, multi-circle-spliced, horseshoe-like and the like sections. The circular sections are the most commonly used sections owing to a lot of advantages. However, tunnels with the circular sections have defects of low utility rate of internal space. The rectangular sections are also employed in constructions, tunnels with the rectangular sections are high in utility rate of internal space but also have obvious defects such as large pressures on segments, complex designs and splicing, high costs and the like. Multi-circle-spliced tunnels are high in utility rate of space, but there are large difficulties in constructions, designs of segments and designs of excavating mechanisms and drive devices of tunnel boring machines, resulting in large manufacturing costs of complete machines. Excavated sections of horseshoe-like tunnel boring machines are nonstandard horseshoe-shaped sections, and horseshoe-like tunnel boring machines include a plurality of cutterheads and drive mechanisms. The horseshoe-like tunnel boring machines are complex in structure with high costs of designs and maintenances, and costs of segment erection and latter constructions are high, therefore, the horseshoe-like tunnel boring machines are not suitable for large-scale promotion and use.

SUMMARY

The present disclosure seeks to solve at least one of the problems existing in the related art to at least some extent. Therefore, the present disclosure provides a tunnel boring machine. A tunnel formed by this tunnel boring machine is high in utility rate of internal space and stability, simple in structure and low in cost, and pressures on segments are low.

The tunnel boring machine according to embodiments of the present disclosure includes: a shield body; a cutterhead assembly, including a main cutterhead and a plurality of auxiliary cutterheads, the main cutterhead being rotatably arranged at a front side of the shield body and defining a soil chamber between the main cutterhead and the shield body, the main cutterhead being movable along an up-down direction, the plurality of auxiliary cutterheads being rotatably arranged in the soil chamber, the plurality of auxiliary cutterheads being adjacent to a bottom of the shield body and arranged at a left side and a right side of a vertical central line of the main cutterhead, a rotation diameter of the main cutterhead is greater than a rotation diameter of the auxiliary cutterhead, and the rotation diameter of the main cutterhead is the same as a maximum width of the shield body; a first drive mechanism configured to drive the main cutterhead to rotate; a second drive mechanism configured to drive the auxiliary cutterheads to rotate; and a third drive mechanism configured to drive the main cutterhead to move up and down.

As for the tunnel boring machine according to the embodiments of the present disclosure, the cutterhead assembly is designed to be a structure that includes the main cutterhead having a large diameter and the plurality of auxiliary cutterheads having small diameters, the plurality of auxiliary cutterheads are located in the soil chamber and adjacent to the bottom of the shield body, and the main cutterhead is movable in the up-down direction. When the tunnel boring machine is used for constructing a tunnel, both the main cutterhead and the plurality of auxiliary cutterheads rotate, and the main cutterhead reciprocates up and down, such that the section formed during excavation is in the shape having a semicircular upper portion and a rectangular lower portion, the tunnel having this section is high in utility rate of internal space, segments are under low pressure, and the stability is high. The tunnel boring machine is simple in structure and low in cost.

According to some embodiments of the present disclosure, two auxiliary cutterheads are provided and arranged at the left side and the right side of the vertical central line of the main cutterhead correspondingly, one of the auxiliary cutterheads is adjacent to a left side wall of the shield body, and the other one of the auxiliary cutterheads is adjacent to a right side wall of the shield body.

According to some embodiments of the present disclosure, the shield body is provided with a separating plate therein, the soil chamber is defined among the shield body, the separating plate and the main cutterhead, the first drive mechanism is arranged in the shield body and located behind the separating plate, the first drive mechanism penetrates the separating plate and is connected to the main cutterhead, and the third drive mechanism is connected to the first drive mechanism.

According to some optional embodiments of the present disclosure, the first drive mechanism is provided with a translational sealing plate, and the translational sealing plate surrounds a periphery of the first drive mechanism, the translational sealing plate is located in the soil chamber and adjacent to the separating plate.

Optionally, a seal ring is arranged between an inner circumferential wall of the translational sealing plate and an outer circumferential wall of the first drive mechanism.

Optionally, the translational sealing plate has a surface facing the separating plate, the surface is provided with a translational sealing member configured to seal a gap between the separating plate and the translational sealing plate.

Further, the translational sealing member is a lip seal, the lip seal has a plurality of lip portions spaced apart from each other, and a lubricating channel is defined between two adjacent lip portions.

Optionally, the surface of the translational sealing plate facing the separating plate is provided with a scrapping member, the scrapping member has a free end, the free end abuts against a surface of the separating plate facing the soil chamber, and the scrapping member is located at an outer side of the translational sealing member in a radial direction.

Further, the scrapping member includes a fixed portion and a scrapping portion, the fixed portion is connected to the translational sealing plate, an end of the scrapping portion is connected to the fixed portion, the other end of the scrapping portion abuts against the surface of the separating plate facing the soil chamber, and the other end of the scrapping portion obliquely extends from the translational sealing plate to the separating plate along a direction away from a center of the translational sealing plate.

Furthermore, the scrapping portion is an elastic member in a state of compression.

Optionally, the tunnel boring machine further includes a flange and a plurality of support legs, an end of each support leg is connected to the main cutterhead, the other end of each support leg is connected to the flange, the flange is rotatably connected to the first drive mechanism and located at a side of the translational sealing plate facing the soil chamber, a surface of the translational sealing plate facing the flange is provided with a rotary sealing member, and the rotary sealing member is used to seal a gap between the flange and the translational sealing plate.

Further, the rotary sealing member is a lip seal, the lip seal has a plurality of lip portions spaced apart from each other, and a lubricating channel is defined between two adjacent lip portions.

According to some embodiments of the present disclosure, the third drive mechanism is provided with a displacement sensor configured to detect a displacement of the first drive mechanism.

According to some embodiments of the present disclosure, the tunnel boring machine further includes a mud discharge pipe and a mud feed pipe, an inlet of the mud discharge pipe and an outlet of the mud feed pipe are both in communication with the soil chamber, and at least one auxiliary cutterhead is adjacent to the inlet of the mud discharge pipe.

According to some embodiments of the present disclosure, the separating plate is provided with a sliding rail extending along the up-down direction, and the first drive mechanism is provided with a sliding block suitable for sliding along the sliding rail.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of the present disclosure will become apparent and more readily appreciated from the following descriptions made with reference to the drawings.

Figure 1:
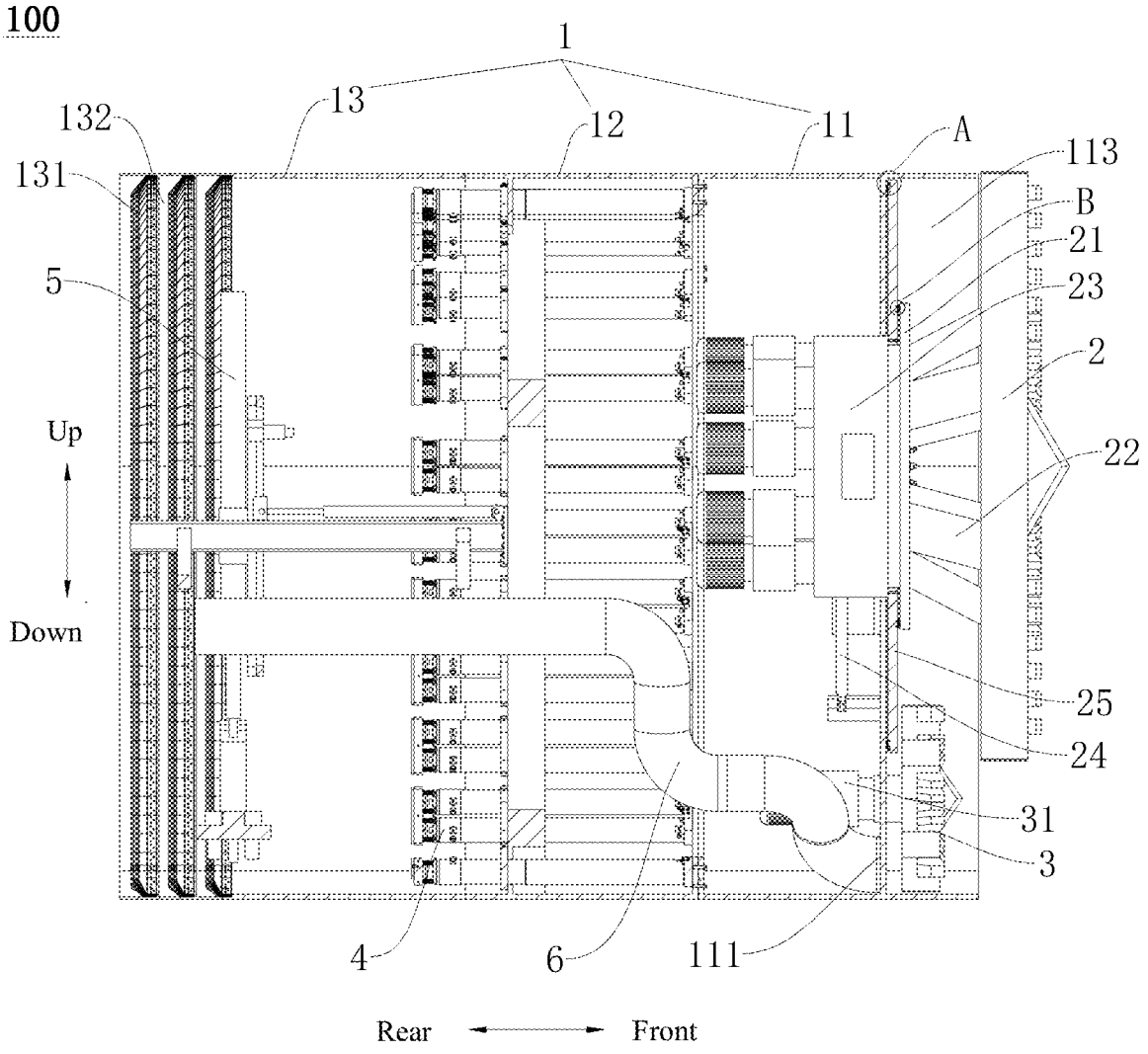
FIG. 1 is a first sectional view of a tunnel boring machine according to an embodiment of the present disclosure, in which a main cutterhead is located at an upper portion.

REFERENCE NUMERALS tunnel boring machine 100;

shield body 1; front shield 11; separating plate 111; sliding rail 112; soil chamber 113; middle shield 12; tail shield 13; shield tail brush 131; sealed chamber 132;

main cutterhead 2; flange 21; supporting leg 22; first drive mechanism 23; third drive mechanism 24; translational sealing plate 25; translational sealing member 251; lip portion 2511; lubricating channel 2512; rotary sealing member 252; lip portion 2521; lubricating channel 2522; scrapping member 253; fixed portion; scrapping portion 2532;

auxiliary cutterhead 3; second drive mechanism 31;

thrusting cylinder 4; segment erector 5; mud discharge pipe 6; mud feed pipe 7.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, and used to generally understand the present disclosure. The embodiments shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise", "axial", "radial" and "circumferential" should be construed to refer to the orientation as then described or as shown in the drawings under discussion. These relative terms are for convenience of description and do not indicate or imply that the device or element referred to must have a particular orientation or must be constructed or operated in a particular orientation. Thus, these terms cannot be constructed to limit the present disclosure. In addition, the feature defined with "first" and "second" indicates or implies that one or more of this feature may be comprised. In the description of the present disclosure, the term "a plurality of" means two or more than two, unless specified otherwise.

In the present disclosure, unless specified or limited otherwise, the terms "mounted," "connected," "coupled," and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A tunnel boring machine 100 according to embodiments of the present disclosure will be described below with reference to FIG. 1 to FIG. 10.

As shown in FIG. 1 to FIG. 10, the tunnel boring machine 100 according to embodiments of the present disclosure includes a shield body 1, a cutterhead assembly, a first drive mechanism 23, a second drive mechanism 31 and a third dive mechanism 24.

Specifically, all the first drive mechanism 23, the second drive mechanism 31 and the third drive mechanism 24 can be arranged in the shield body 1. The cutterhead assembly includes a main cutterhead 2 and a plurality of auxiliary cutterheads 3. The shield body 1 has an open front side. One main cutterhead 2 is provided and rotatably arranged at the front side of the shield body 1, and a spin axis of the main cutterhead 2 extends along a front-rear direction. The main cutterhead 2 and the shield body 1 define a soil chamber 113 therebetween, and the main cutterhead 2 is movable along an up-down direction. The first drive mechanism 23 is configured to drive the main cutterhead 2 to rotate, and the third drive mechanism 24 is configured to drive the main cutterhead 2 to move up and down.

All the plurality of auxiliary cutterheads 3 are rotatably arranged in the soil chamber 113. A spin axis of each auxiliary cutterhead 3 extends along the front-rear direction. All the plurality of auxiliary cutterheads 3 are arranged behind the main cutterhead 2, and planes of rotation of the plurality of auxiliary cutterheads 3 can be located in the same plane. The plurality of auxiliary cutterheads 3 are adjacent to a bottom of the shield body 1 and arranged at two sides (a left side and a right side) of a vertical central line of the main cutterhead 2 (the vertical central line of the main cutterhead 2 refers to a central line of the main cutterhead 2 in a vertical plane, and the central line extends along the up-down direction). Some of the plurality of auxiliary cutterheads 3 are located at the left side of the vertical central line of the main cutterhead 2, and the others of the plurality of auxiliary cutterheads 3 are located at the right side of the vertical central line of the main cutterhead 2. The second drive mechanism 31 is configured to drive the plurality of auxiliary cutterheads 3 to rotate, and the plurality of auxiliary cutterheads 3 can share one second drive mechanism 31, i.e. the one second drive mechanism 31 drives the plurality of auxiliary cutterheads 3 to rotate at the same time. A plurality of second drive mechanisms 31 can be provided, each auxiliary cutterhead 3 is provided with one second drive mechanism 31, and each auxiliary cutterhead 3 is driven to rotate by means of the corresponding second drive mechanism 31. The auxiliary cutterhead 3 located at the far left may be arranged adjacent to a left side wall of the shield body 1, and the auxiliary cutterhead 3 located at the far right may be arranged adjacent to a right side wall of the shield body 1.

A rotation diameter of the main cutterhead 2 is the same as a maximum width of the shield body 1 and greater than a rotation diameter of the auxiliary cutterhead 3. It should be noted that the rotation diameter of the main cutterhead 2 being the same as the maximum width of the shield body 1 (the maximum width of the shield body 1 refers to the maximum size of the shield body 1 in a left-right direction) means that the rotation diameter of the main cutterhead 2 is substantially the same as the maximum width of the shield body 1, and the rotation diameter of the main cutterhead 2 may be slightly greater than the maximum width of the shield body 1.

The main cutterhead 2 has a circular excavation face, and the main cutterhead 2 may have a circular section. The diameter of the main cutterhead 2 matches the size of the shield body 1 of the tunnel boring machine 100. The main cutterhead 2 may be provided with a scraper, a hob, a tearing cutter, an over cutter, and the like, and a detector for detecting abrasion of cutters and the main cutterhead 2. An area of the excavation face of the main cutterhead 2 can be 85% of an area of a tunneling face.

Each auxiliary cutterhead 3 has a circular excavation face, and a diameter of excavation of each auxiliary cutterhead 3 is small. The plurality of auxiliary cutterheads 3 can cut and excavate portions which are not excavated by the main cutterhead 2. The plurality of auxiliary cutterheads 3 can stir and break large-scale mucks and rocks entering the soil chamber 113, thereby preventing a mud discharge pipe 6 of the tunnel boring machine 100 from jamming during tunneling.

When the tunnel boring machine 100 works, under the composite action of rotation and up-down reciprocation, the main cutterhead 2 excavates and forms an excavation section having a semicircular upper end, a semicircular lower end and a rectangular middle portion. All the plurality of auxiliary cutterhead 3 adjacent to the bottom of the shield body 1 rotate, thereby cutting and excavating a tunnel face which is not cut by the main cutterhead 2, such that the whole excavation face of the tunnel boring machine 100 can be cut. An excavation section having a semicircular upper portion and a rectangular lower portion can be excavated and formed by means of the cooperation of the main cutterhead 2 and the plurality of auxiliary cutterheads 3, thereby form a standard horseshoe-shaped section.

A tunnel having such section is high in utility rate of internal space, the tunnel has a semicircular upper portion, and the stress condition of the upper portion is similar to that of an arch of a circular section. Segments are under low external pressure, such that tops of the segments can have good mechanical property. The segments are damaged slightly and have a long service life, such that costs of later construction are reduced, stability of the tunnel is enhanced and the safety of the whole tunnel can be guaranteed in a long term. On the premise that the tunnel needs no large later construction, the tunnel boring machine can be conveniently applied to city subway tunnels, highway tunnels and utility tunnels.

The tunnel boring machine 100 is simple in structure and relatively low in manufacturing cost, and a tunnel formed by the tunnel boring machine 100 can meet requirements of many project constructions.

It should be noted that, the front-rear direction described in the present disclosure refers to the moving direction of the working tunnel boring machine 100, that is the forward direction of the working tunnel boring machine 100 is the front, and the direction which is opposite to the forward direction is the rear.

Optionally, the first drive mechanism 23 can include a plurality of hydraulic motors or electric motors, a speed reducer, a rotation support and related accessories. The first drive mechanism 23 can convert hydraulic energy or electric energy into mechanical energy to drive the main cutterhead 2 to rotate. The first drive mechanism 23 can drive the main cutterhead 2 to rotate in a forward direction or a reverse direction. When the tunnel boring machine 100 tunnels, the third drive mechanism 24 drives the main cutterhead 2 to reciprocate in a vertical direction. The third drive mechanism 24 may be a cylinder, such as a double-acting hydraulic cylinder. The third drive mechanism 24 may be connected with the first drive mechanism 23, the third drive mechanism 24 drives the first drive mechanism 23 to reciprocate up and down in the vertical direction, thereby driving the main cutterhead 2 to reciprocate up and down in the vertical direction, such that the main cutterhead 2 forms a non-circular cutting face.

Optionally, the second drive mechanism 31 can includes one high-power hydraulic motor or electric motor, a speed reducer and related accessories. The second drive mechanism 31 converts hydraulic energy or electric energy into mechanical energy to drive the auxiliary cutterhead 3 to rotate. The second drive mechanism 31 can drive the auxiliary cutterhead 3 to rotate in a forward direction or a reverse direction. If the auxiliary cutterheads 3 get stuck by rocks during tunneling, the auxiliary cutterheads 3 can rotate in the reverse direction to break the rocks, thereby reducing the particle size of the rocks.

Optionally, the shield body 1 can have a cross section in the shape which is the same as the shape of a section excavated by the cutterhead assembly of the tunnel boring machine 100, that is, the cross section of the shield body 1 is in the shape of a standard horseshoe. When the cross section of the shield body 1 is uniform, the size of the cross section of the shield body 1 is substantially the same as that of the section excavated by the cutterhead assembly. When the cross section of the shield body 1 reduces gradually along the front-rear direction, the shield body 1 can be conical, and a size of a maximum cross section of the shield body 1 is substantially the same as that of the section excavated by the cutterhead assembly, thereby reducing frictional resistance between the shield body 1 and the soil.

As for the tunnel boring machine 100 according to the embodiments of the present disclosure, the cutterhead assembly is designed to be the structure that includes the main cutterhead 2 having a large diameter and the plurality of auxiliary cutterheads 3 having small diameters, the plurality of auxiliary cutterheads 3 are located in the soil chamber 113 and adjacent to the bottom of the shield body 1, and the main cutterhead 2 is movable in the up-down direction. When the tunnel boring machine 100 is used for constructing the tunnel, both the main cutterhead 2 and the plurality of auxiliary cutterheads 3 rotate, and the main cutterhead 2 reciprocates up and down, such that the section formed during excavation is in the shape having the semicircular upper portion and the rectangular lower portion, the tunnel having this section is high in utility rate of internal space, segments are under low pressure, and the stability is high. The tunnel boring machine 100 is simple in structure and low in cost.

According to some embodiments with reference to FIGS. 1, 4, 5 and 7-9, two auxiliary cutterheads 3 are provided and arranged at two sides (the left side and the right side) of the vertical central line of the main cutterhead 2 respectively. One of the auxiliary cutterheads 3 is adjacent to a left side wall of the shield body 1, and there is a gap between the auxiliary cutterheads 3 and the left side wall of the shield body 1. The other one of the auxiliary cutterheads 3 is adjacent to a right side wall of the shield body 1, and there is a gap between the auxiliary cutterheads 3 and the right side wall of the shield body 1. There are gaps between peripheries of the two auxiliary cutterheads 3 and the bottom wall of the shield body 1, such that there is space for movements of the two auxiliary cutterheads 3. The two auxiliary cutterheads 3 can cut and excavate portions which are not excavated by the main cutterhead 2 to form a section having a semicircular upper portion and a rectangular lower portion, and the cutterhead assembly of the tunnel boring machine 100 is simpler in structure and lower in cost.

According to some embodiments with reference to FIGS. 1, 4, 5, 7 and 8, the shield body 1 is provided with a separating plate 111 therein. The separating plate 111 is arranged along the vertical direction and connected with an inner wall of the shield body 1. The mentioned soil chamber 113 is defined among the inner wall of the shield body 1, the separating plate 111 and the main cutterhead 2. The first drive mechanism 23 is arranged in the shield body 1 and located behind the separating plate 111, the first drive mechanism 23 penetrates the separating plate 111 and is connected to the main cutterhead 2, and the third drive mechanism 24 is connected to the first drive mechanism 23. Therefore, the tunnel boring machine 100 is reasonable and compact in structure design, and the third drive mechanism 24 drives the first drive mechanism 23 to reciprocate up and down in the up-down direction, such that the main cutterhead 2 can conveniently rotate and reciprocate up and down at the same time.

In some embodiments of the present disclosure with reference to FIG. 1, FIG. 4, FIG. 7 and FIG. 8, the first drive mechanism 23 is provided with a translational sealing plate 25, and the translational sealing plate 25 surrounds the periphery of the first drive mechanism 23. The translational sealing plate 25 is located in the soil chamber 113 and adjacent to the separating plate 111. The translational sealing plate 25 is arranged in the vertical direction and parallel to and opposite to the separating plate 111, the translational sealing plate 25 is located in front of the separating plate 111, and there is a gap (the gap is small as long as the translational sealing plate 25 can move up and down) between the translational sealing plate 25 and the separating plate 111. When the first drive mechanism 23 moves along the up-down direction, the translational sealing plate 25 also moves in the up-down direction along with the first drive mechanism 23. Therefore, the translational sealing plate 25 can prevent mud, soil and the like in the soil chamber 113 from entering the drive mechanisms, including the first drive mechanism 23, the second drive mechanism 31 and the third mechanism 24, in the shield body 1. It should be noted that, during up-down movement of the translational sealing plate 25, the translational sealing plate 25 always has a portion corresponding to the separating plate 111, such that the translational sealing plate 25 can prevent the mud, soil and the like in the soil chamber 113 from entering the drive mechanisms in the shield body 1 during operation of the tunnel boring machine 100.

The translational sealing plate 25 can be a structural member made of high strength steel. The translational sealing plate 25 can be connected to the first drive mechanism 23 through a bolt. The high strength of the translational sealing plate 25 can ensure that the translational sealing plate 25 does not deform or only deforms slightly without influence on design function when impacted by the soil and rocks in the soil chamber 113.

Optionally, a seal ring is arranged between an inner circumferential wall of the translational sealing plate 25 and an outer circumferential wall of the first drive mechanism 23, thereby ensuring the sealing performance of the whole soil chamber 113, and further preventing the mud, soil and the like in the soil chamber 113 from entering the first drive mechanism 23. A plurality of oil holes can be machined in the translational sealing plate 25, and oil seals and lubricates the seal ring through corresponding holes.

Figure 2:
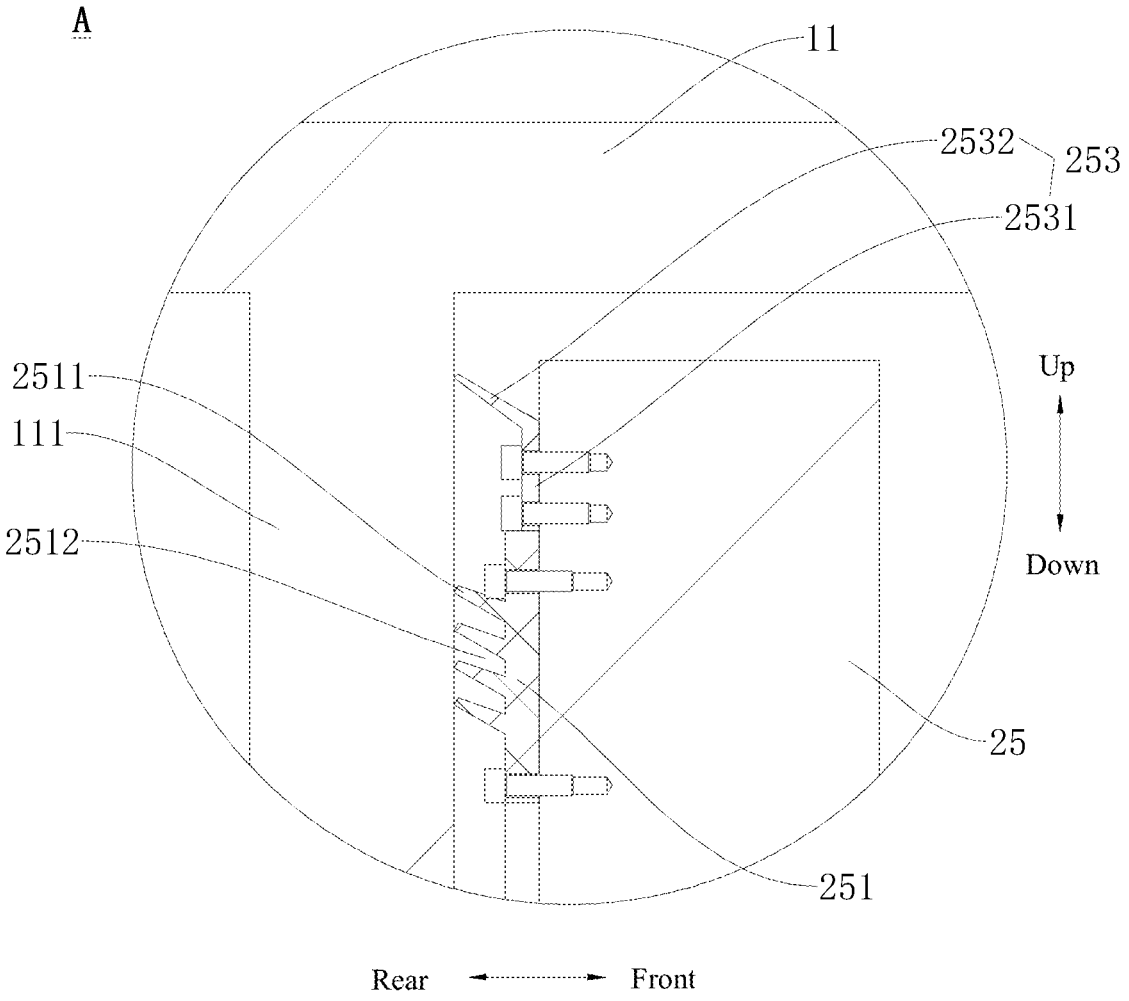
FIG. 2 is an enlarged view of portion A in FIG. 1.

Furthermore, the referring to FIG. 2 and combining with FIGS. 1, 4, 7 and 8, the translational sealing plate 25 has a surface facing the separating plate 111, the surface is provided with a translational sealing member 251 for sealing the gap between the separating plate 111 and the translational sealing plate 25. The translational sealing member 251 can be connected to the translational sealing plate 25 by means of bolts. The translational sealing member 251 can be an annular sealing ring and arranged in the circumferential direction of the translational sealing plate 25. Therefore, during up-down movement of the translational sealing plate 25, the translational sealing member 251 can seal the gap between the separating plate 111 and the translational sealing plate 25, thereby further preventing the mud, soil and the like in the soil chamber 113 from entering the drive mechanisms in the shield body 1. Optionally, the translational sealing member 251 can be a lip seal, the lip seal has a plurality of annular lip portions 2511 spaced apart from each other along a radial direction of the translational sealing plate 25, and a lubricating channel 2512 is defined between two adjacent lip portions 2511. During excavation by means of the tunnel boring machine 100, the oil is fed into the lubricating channel 2512 continuously through the corresponding oil hole, thereby further ensuring the sealing performance on a sealing face.

In some optional embodiments of the present disclosure, referring to FIG. 2 and combining with FIGS. 1, 4, 7 and 8, the surface of the translational sealing plate 25 facing the separating plate 111 is provided with a scrapping member 253. The scrapping member 253 has a free end (a rear end of the scrapping member 253 with reference to FIG. 2), and the free end abuts against a surface (a front surface of the separating plate 111 with reference to FIG. 2) of the separating plate 111 facing the soil chamber 113. The scrapping member 253 may be annular and located at an outer side of the translational sealing member 251 in a radial direction (the radial direction refers to a radial direction of the translational sealing plate 25). Therefore, by providing and arranging the scrapping member 253 at the outer side of the translational sealing member 251 in the radial direction, during up-down reciprocation of the main cutterhead 2 and the first drive mechanism 23 in the vertical direction, the scrapping member 253 can scrap and clean the mud and the like sundries on the sealing face of the separating plate 111 in advance of the translational sealing member 251, thereby protecting the translational sealing member 251. Optionally, the scrapping member 253 can be arranged adjacent to an outer edge of the translational sealing plate 25, thereby further protecting the translational sealing plate 251.

Furthermore, referring to FIG. 2, the scrapping member 253 includes a fixed portion 2531 and a scrapping portion 2532, and the fixed portion 2531 is connected to the scrapping portion 2532. The fixed portion 2531 can be fixed to the translational sealing plate 25 by means of screws. An end of the scrapping portion 2532 is connected to the fixed portion 2531, the other end of the scrapping portion 2532 extends towards the separating plate 111 and abuts against the surface (the front surface of the separating plate 111 with reference to FIG. 2) of the separating plate 111 facing the soil chamber 113, and the other end of the scrapping portion 2532 obliquely extends from the translational sealing plate 25 to the separating plate 111 along a direction away from a center of the translational sealing plate 25 (referring to FIG. 2, the other end of the scrapping portion 2532 obliquely extends from the front to the rear along the direction away from the center of the translational sealing plate 25). Therefore, during up-down reciprocation of the main cutterhead 2 and the first drive mechanism 23 in the vertical direction, the scrapping portion 2532 can serve as a guide when scraping and cleaning the mud and the like sundries on the sealing face of the separating plate 111, such that the sundries can be separated from the sealing face of the separating plate 111 conveniently with better cleaning effect.

Optionally, the scrapping portion 2532 can be an elastic member in a state of compression. Therefore, if the scrapping member 253 wears during using, the scrapping portion 2532 is self-compensating because the scrapping portion 2532 of the scrapping member 253 is the elastic member in the state of compression. When mounting the scrapping member 253, the scrapping portion 2532 can be compressed and deformed during mounting by adjusting the gap between the translational sealing plate 25 and the separating plate 111. Optionally, the scrapping portion 2532 of the scrapping member 253 can be made of high-strength elastic steel, such as spring steel. Of course, the whole scrapping member 253 can be made of the high-strength elastic steel.

In other embodiments, the scrapping portion 2532 itself can be nonelastic, the scrapping portion 2532 can be connected to the fixed portion 2531 by means of a spring, and the spring is in a state of compression, which also can enable the scrapping portion 2532 to be self-compensating in case of wearing.

Figure 3:
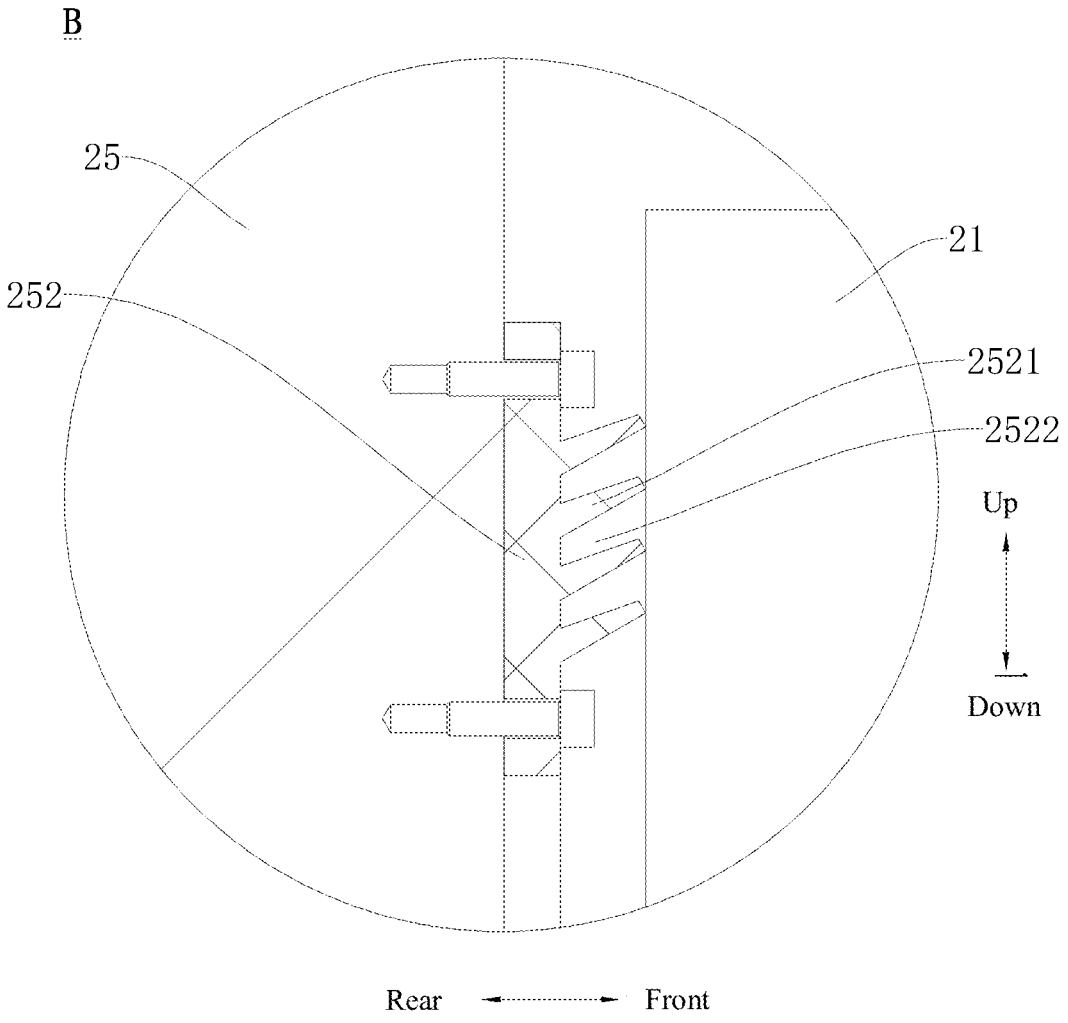
FIG. 3 is an enlarged view of portion B in FIG. 1.
Figure 4:
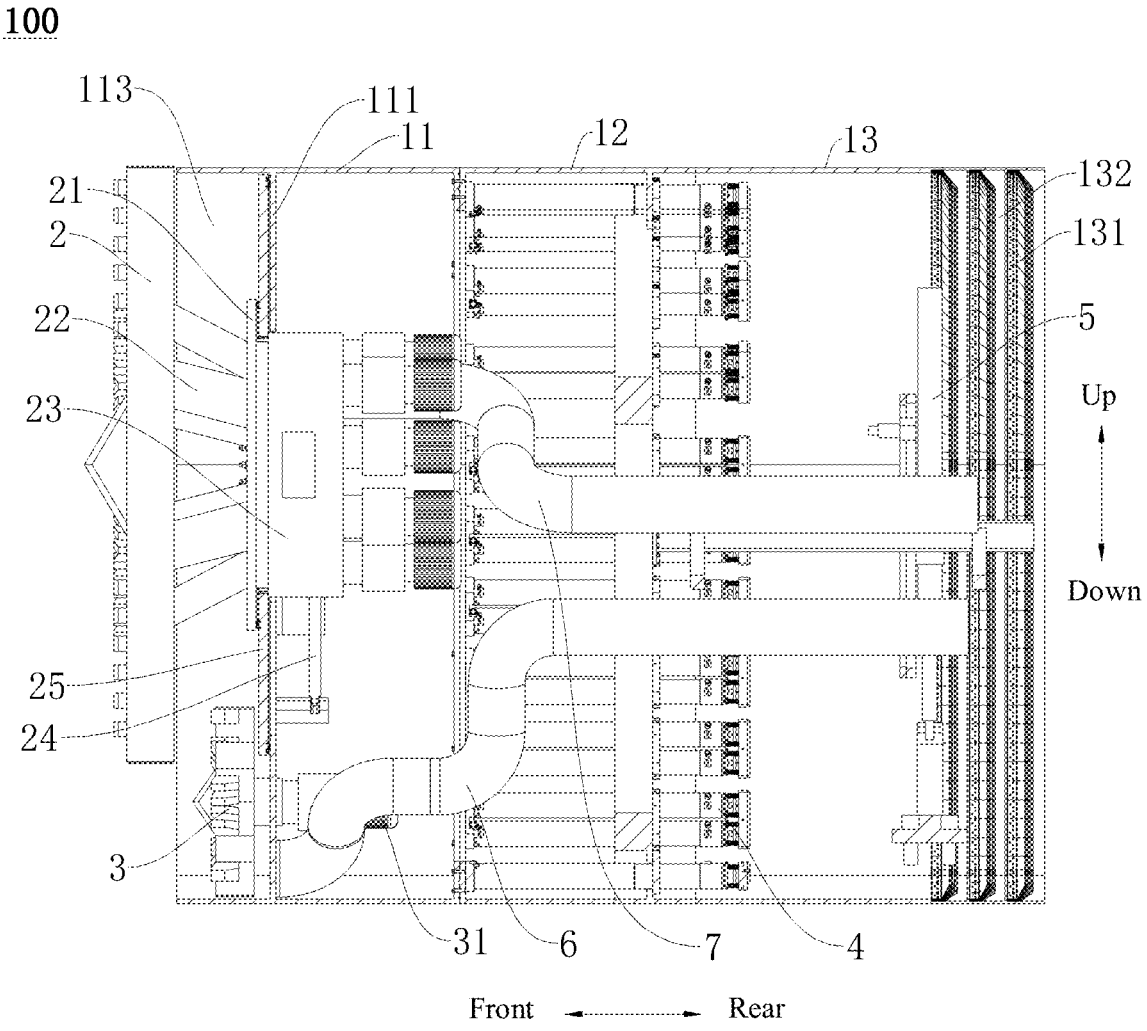
FIG. 4 is a second sectional view of a tunnel boring machine according to an embodiment of the present disclosure, in which a main cutterhead is located at an upper portion.
Figure 5:
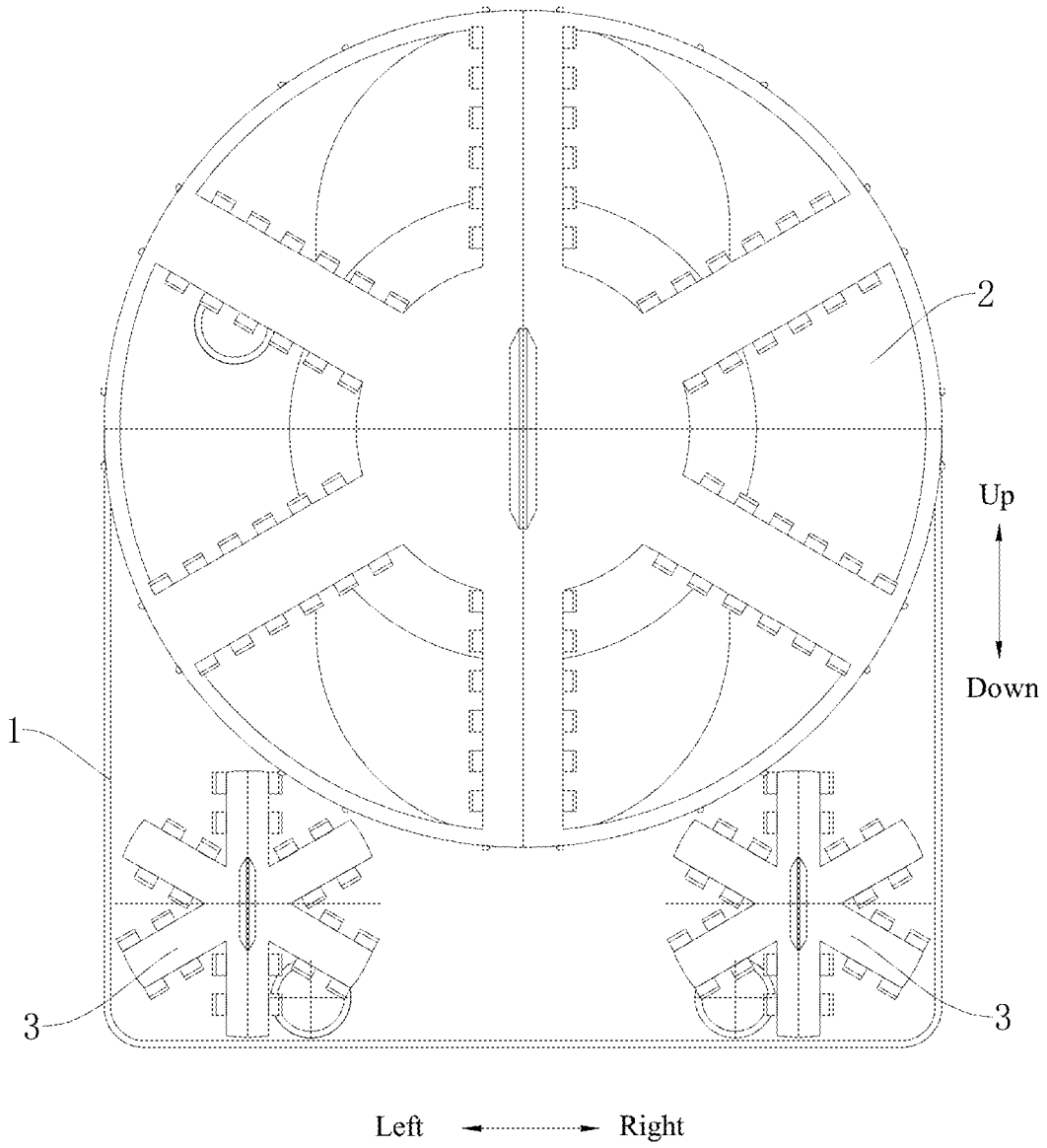
FIG. 5 is a front schematic view of a cutterhead assembly of a tunnel boring machine according to an embodiment of the present disclosure, in which a main cutterhead is located at an upper portion.

According to some optional embodiments, referring to FIG. 3 and combining with FIGS. 1, 4, 7 and 8, the tunnel boring machine 100 includes a flange 21 and a plurality of support legs 22. An end of each support leg 22 is connected to the main cutterhead 2, and the other end of each support leg 22 is connected to the flange 21. The plurality of support legs 22 surround the center of the main cutterhead 2 and are spaced apart from each other. The flange 21 is rotatably connected to the first drive mechanism 23 and located at a side of the translational sealing plate 25 facing the soil chamber 113. A surface of the translational sealing plate 25 facing the flange 21 is provided with a rotary sealing member 252, and the rotary sealing member 252 is used for sealing a gap between the flange 21 and the translational sealing plate 25. The flange 21 is arranged in the vertical direction and parallel and opposite to the translational sealing plate 25. The flange 21 is located in front of the translational sealing plate 24, and there is a gap (which is small so long as the flange 21 can rotate) between the flange 21 and the translational sealing plate 25. When the first drive mechanism 23 drives the flange 21 to rotate, the main cutterhead 2 is driven to rotate. Therefore, the main cutterhead 2 is conveniently connected to the first drive mechanism 23, and the structural strength and the support strength of the main cutterhead 2 can be enhanced. The rotary sealing member 252 can prevent the soil and mud in the soil chamber 113 from entering the drive mechanisms in the shield body 1.

Optionally, the rotary sealing member 252 can be a lip seal. The lip seal has a plurality of lip portions 2521 spaced apart from each other along the radial direction of the translational sealing plate 25, and a lubricating channel 2522 is defined between two adjacent lip portions 2521. During excavation by means of the tunnel boring machine 100, the oil is fed into the lubricating channel 2522 continuously through the corresponding oil hole, thereby further ensuring the sealing performance of the sealing face.

According to some embodiments of the present disclosure, the third drive mechanism 24 is provided with a displacement sensor configured to detect a displacement of the first drive mechanism 23. Therefore, the displacement sensor can judge a position of the first drive mechanism 23. When the first drive mechanism 23 reaches an end of a set stroke, a controller controls the third drive mechanism 24 to drive the first drive mechanism 23 to move towards the opposite direction, according to information about displacements detected by the displacement sensor. Therefore, the first drive mechanism 23 can reciprocate up and down, that is the main cutterhead 2 can reciprocate up and down. Optionally, the displacement sensor can be a built-in displacement sensor.

According to some embodiments of the present disclosure, referring to FIGS. 1, 4, 6-8 and 10, the tunnel boring machine 100 includes a mud discharge pipe 6 and a mud feed pipe 7. An inlet of the mud discharge pipe 6 and an outlet of the mud feed pipe 7 are both in communication with the soil chamber 113. During excavation by means of the tunnel boring machine 100, the soil and mud in the soil chamber 113 can be discharged to the ground through the mud discharge pipe 6, such that the tunnel boring machine 100 can smoothly excavate. The mud feed pipe 7 serves as a pipe through which the mud enters the soil chamber 113 after circulating filtration at the external. By controlling feeding mud amount of the mud feed pipe 7 and the discharging mud amount of the mud discharge pipe 6, the pressure on the mud in the soil chamber 113 can be effectively controlled, thereby further ensuing the stability of the excavation face. At least one auxiliary cutterhead 3 is adjacent to the inlet of the mud discharge pipe 6, that is there may be one auxiliary cutterhead 3 adjacent to the inlet of the mud discharge pipe 6 or a plurality of auxiliary cutterheads 3 adjacent to the inlet of the mud discharge pipe 6. Therefore, large-size soil adjacent to the inlet of the mud discharge pipe 6 can be stirred and cut by means of the auxiliary cutterhead 3, thereby further preventing the mud discharge pipe 6 from jamming.

Figure 6:
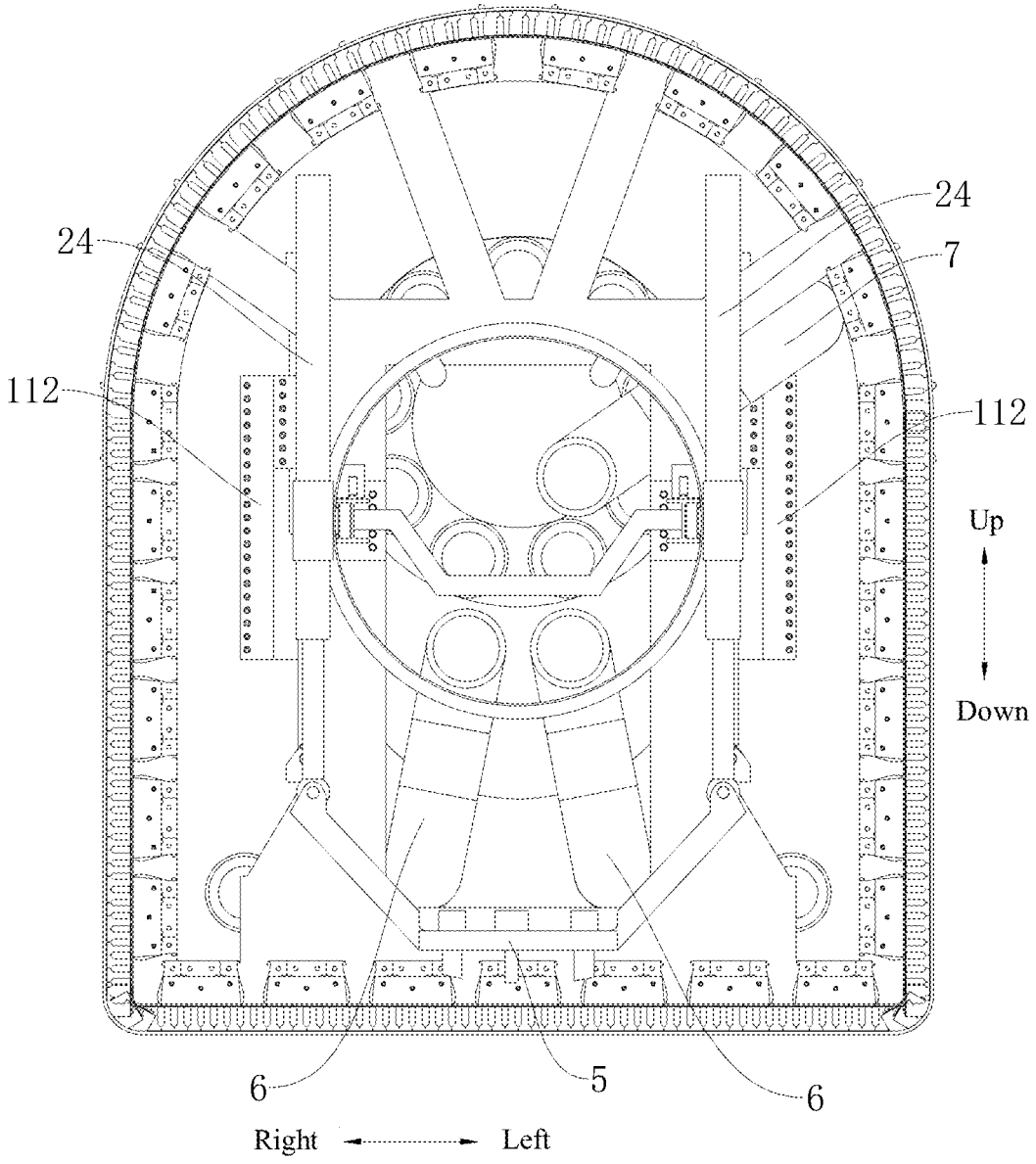
FIG. 6 is a back schematic view of a cutterhead assembly of a tunnel boring machine according to an embodiment of the present disclosure, in which a main cutterhead is located at an upper portion.
Figure 7:
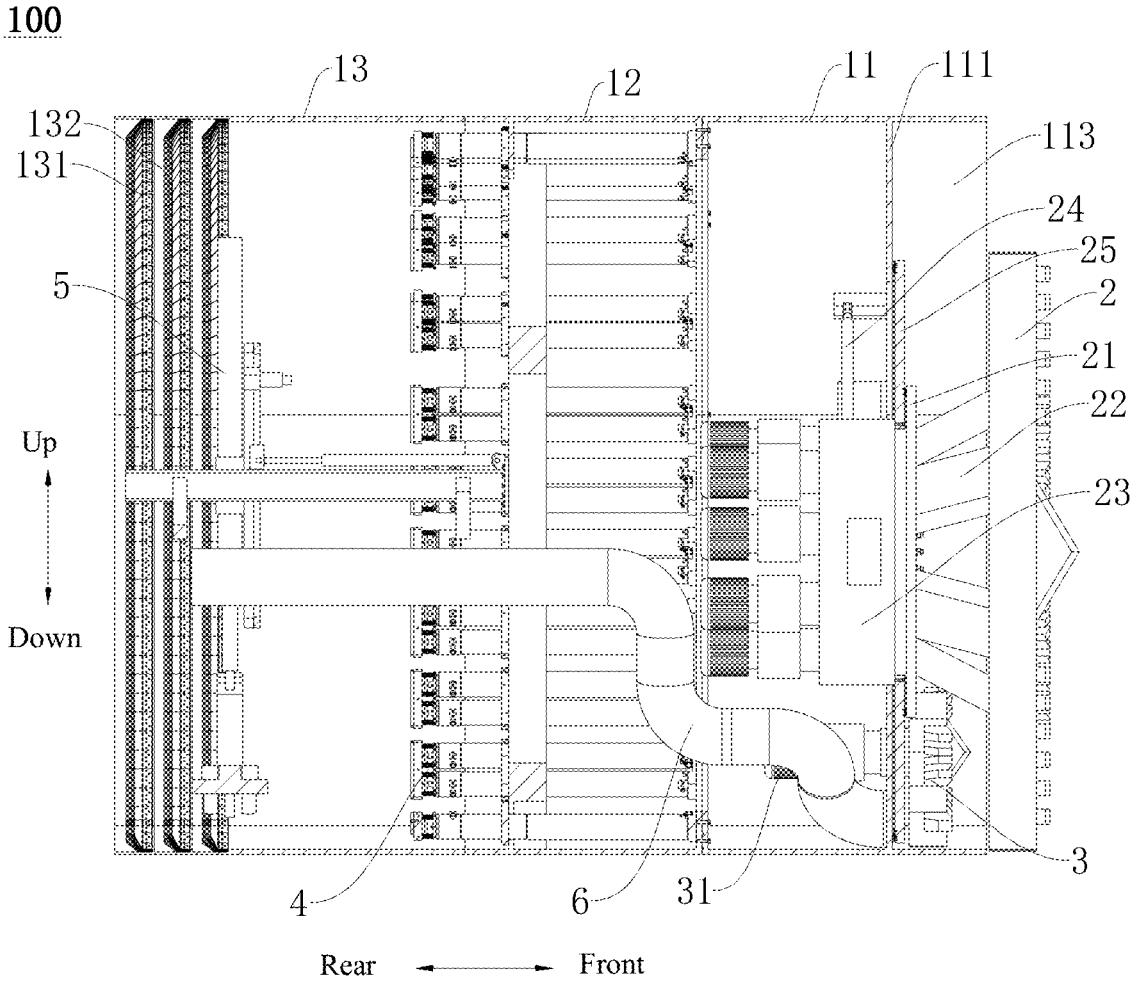
FIG. 7 is a third sectional view of a tunnel boring machine according to an embodiment of the present disclosure, in which a main cutterhead is located at a lower portion.
Figure 8:
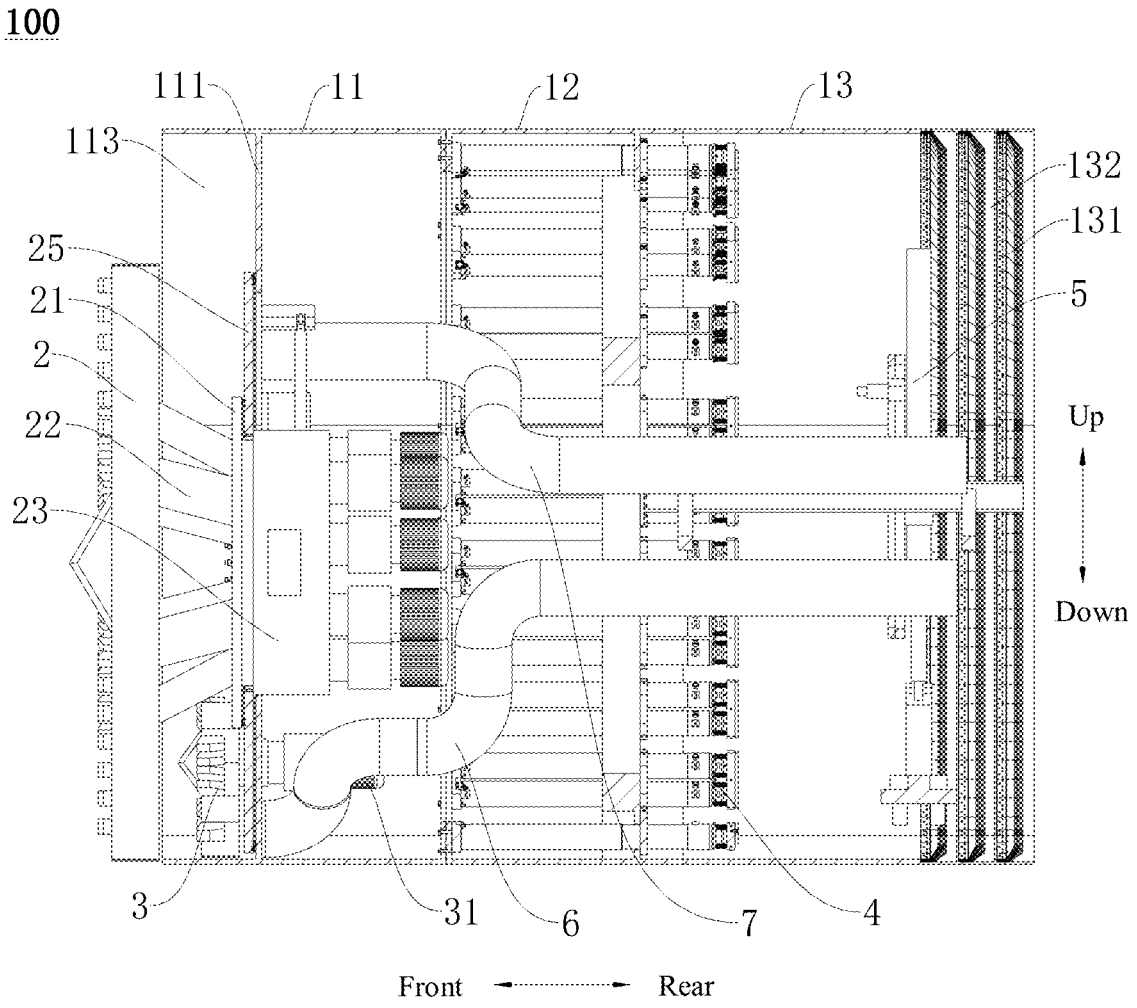
FIG. 8 is a fourth sectional view of a tunnel boring machine according to an embodiment of the present disclosure, in which a main cutterhead is located at a lower portion.
Figure 9:
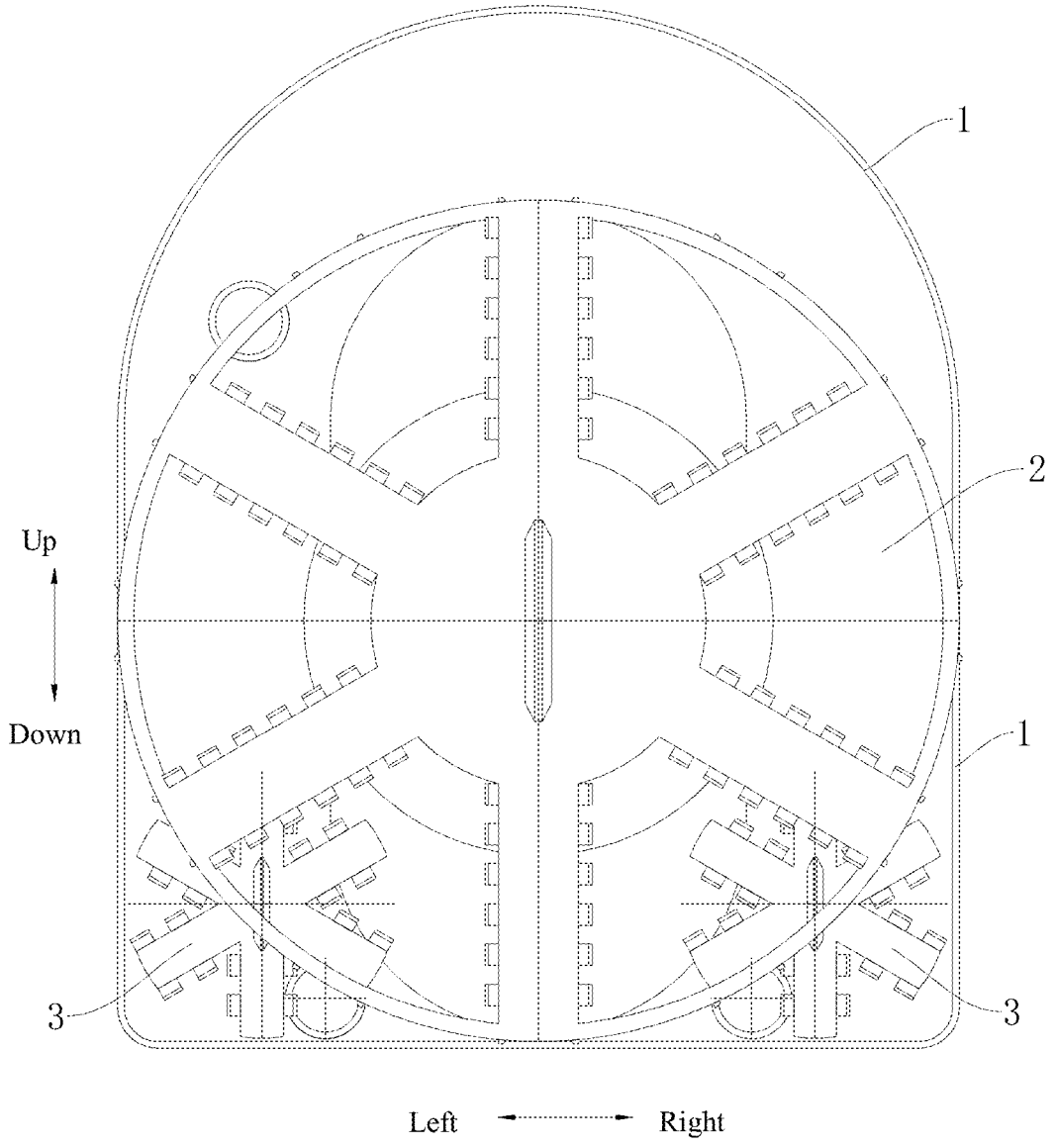
FIG. 9 is a front schematic view of a cutterhead assembly of a tunnel boring machine according to an embodiment of the present disclosure, in which a main cutterhead is located at a lower portion.
Figure 10:
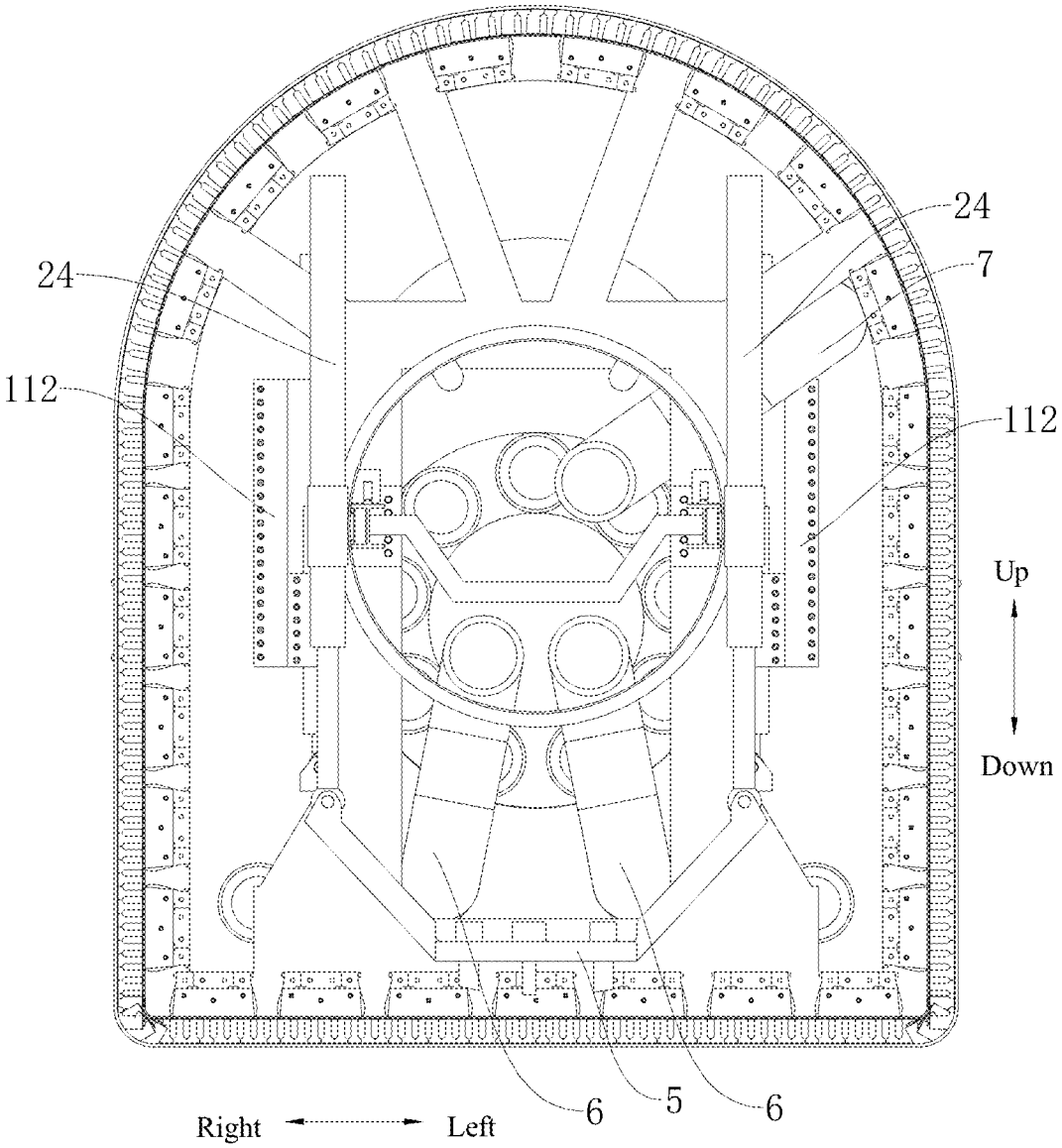
FIG. 10 is a back schematic view of a cutterhead assembly of a tunnel boring machine according to an embodiment of the present disclosure, in which a main cutterhead is located at a lower portion.

According to some embodiments of the present disclosure, referring to FIGS. 6 and 10, the separating plate 111 is provided with a sliding rail 112 extending along the up-down direction, and the first drive mechanism 23 is provided with a sliding block suitable for sliding along the sliding rail 112. Therefore, the first drive mechanism 23 and the main cutterhead 2 can reciprocate up and down in the vertical direction under the action of the third drive mechanism 24, and can bear an axial load transmitted by the main cutterhead 2 during tunneling.

A tunnel boring machine 100 according to an embodiment of the present disclosure will be described below with reference to FIGS. 1 to 10.

Referring to FIGS. 1 to 10, in the present embodiment, the tunnel boring machine 100 includes a shield body 1, a main cutterhead 2, two auxiliary cutterheads 3, a flange 21, a plurality of support legs 22, a first drive mechanism 23, a second drive mechanism 31, a third drive mechanism 24, a separating plate 111, a translational sealing plate 25, a translational sealing member 251, a rotary sealing member 252, a mud discharge pipe 6, a mud feed pipe 7, a thrusting cylinder 4 and a segment erector 5 and so on.

The shield body 1 serves as a support structure of the tunnel boring machine 100. The shield body includes a front shield 11, a middle shield 12 and a tail shield 13 which are connected sequentially from the front to the rear. Each of the front shield 11, the middle shield 12 and the tail shield 13 has a standard horseshoe-shaped section, and the size of the section is substantially the same as that of an excavation face of a cutterhead assembly. The front shield 11 is connected to the middle shield 12 by means of bolts, and an O-shaped seal ring is mounted between the front shield 11 and the middle shield 12 to ensure the sealing performance. The middle shield 12 is connected to the tail shield 13 by welding.

The separating shield 111 is arranged in the front shield 11 and connected to an inner wall of the front shield 11. The main cutterhead 2 is arranged at a front side of the front shield 11. The inner wall of the front shield 11, the separating plate 111 and the main cutterhead 2 cooperatively define a soil chamber 113. The first drive mechanism 23 penetrates the separating plate 111 and is connected to the main cutterhead 2 by means of the flange 21 and the plurality of support legs 22. The flange 21 is rotatably connected to the first drive mechanism 23. The plurality of support legs 22 surround the center of the main cutterhead 2 and are spaced apart from each other. Two ends of each support leg 22 are connected to the flange 21 and the main cutterhead 2 respectively. The third drive mechanism 24 is provided in the front shield 11 and located behind the separating plate 111. The third drive mechanism 24 is an cylinder which is connected to the first drive mechanism 23, and the third drive mechanism 24 is provided with a displacement sensor configured to detect a displacement of the first drive mechanism 23. The separating plate 111 is provided with a sliding rail 112 extending along an up-down direction, and the first drive mechanism 23 is provided with a sliding block suitable for sliding along the sliding rail 112.

The two auxiliary cutterheads 3 are arranged in the soil chamber 113. The two auxiliary cutterheads are arranged adjacent to a bottom of the shield body 1 and located at two sides (a left side and a right side) of a vertical central line of the main cutterhead 2 respectively. One of the two auxiliary cutterheads 3 is arranged adjacent to a left side wall of the shield body 1, and the other one of the two auxiliary cutterheads 3 is arranged adjacent to a right side wall of the shield body 1. Two second drive mechanisms 31 are provided in the front shield 12, and each second drive mechanism 31 penetrates the separating plate 111 and is connected to the corresponding auxiliary cutterhead 3.

The translational sealing plate 25 surrounds a periphery of the first drive mechanism 23 and is connected to the first drive mechanism 23. A seal ring is arranged between an inner circumferential wall of the translational sealing plate 25 and an outer circumferential wall of the first drive mechanism 23. The translational sealing plate 25 is located in the soil chamber 113 and between the separating plate 111 and the flange 21. That is, in the direction from the front to the rear, the flange 21, the translational sealing plate 25 and the separating plate 111 are arranged sequentially. There is a small gap between the translational sealing plate 25 and the separating plate 111, and the gap not only enables the translational sealing plate 25 to reciprocate up and down, but also ensures the sealing performance between the translation sealing plate 25 and the separating plate 111. There is a small gap between the translational sealing plate 25 and the flange 21, and the gap not only enables the flange 21 to rotate, but also ensures the sealing performance between the translation sealing plate 25 and the flange 21.

The translational sealing plate 25 has a surface facing the separating plate 111, and the surface is provided with an annular translational sealing member 251. The translational sealing member 251 is adjacent to the periphery of the translational sealing plate 25. The translational sealing member 251 is a lip seal. The lip seal has a plurality of annular lip portions 2511 which are spaced apart from each other along a radial direction of the translational sealing plate 25, and a lubricating channel 2512 is defined between two adjacent lip portions 2511. The surface of the translational sealing plate 25 facing the separating plate 111 is provided with an annular scrapping member 253, and the scrapping member 253 is located at an outer side of the translational sealing member 251 in the radial direction. The scrapper 253 includes a fixed portion 2531 and a scrapping portion 2532, and the fixed portion 2531 is connected to the translational sealing plate 25. An end of the scrapping portion 2532 is connected to the fixed portion 2531, and the other end of the scrapping portion 2532 obliquely extends from the translational sealing member 25 to the separating plate 111 in a direction away from the center of the translational sealing member 25 and abuts against the separating plate 111. The scrapping portion 2532 can be an elastic member in a state of compression. The translational sealing plate 25 has a surface facing the flange 21, and the surface is provided with a rotary sealing member 252. The rotary sealing member 252 is a lip seal, the lip seal has a plurality of lip portions 2521 which are spaced apart from each other along the radial direction of the translational sealing plate 25, and a lubricating channel 2522 is defined between two adjacent lip portions 2521.

A support is mounted in the middle shield 12, and the support is used for supporting the shield body 1. Threaded holes are machined in the support for conveniently mounting and positioning of the segment erector 5. The segment erector 5 is connected to the support in the middle shield 12 through bolts, and the segment erector 5 can be a center-rotary erector. The segment erector 5 includes a travel beam, a travel mechanism, a lift cylinder, a translational cylinder, a grab mechanism, a grab cylinder and a fine adjustment cylinder. The segment erector is mainly used for erecting segments, which are suitable for the shape of an excavation section by means of the tunnel boring machine, into a ring.

A plurality of thrusting cylinders 4 are mounted in the middle shield 12. A connecting line of centers of the plurality of thrusting cylinders 4 coincide with the central line of the segments in a thickness direction. The plurality of thrusting cylinders 4 may be mounted in groups and arranged in different regions. The plurality of thrusting cylinders 4 may stretch out and draw back in different regions or stretch out and draw back individually according to requirements. For example, the plurality of thrusting cylinders 4 may be arranged in four regions, i.e. an upper region, a lower region, a left region and a right region. An upper arc surface area is donated as a region A, a lower portion adjacent to the bottom of the shield body 1 is donated as a region C, and a left end and a right end of the shield body 1 are donated as a region D and a region B respectively. The cylinders in each region can be controlled individually, such that the tunnel boring machine 100 can conveniently adjust its tunnel posture and make a turn.

Three shield tail brushes 131 are welded to a tail portion of the tail shield 13. Sealing oil can be injected into two sealed chambers 132 defined by the three shield tail brushes 131, thereby achieving a sealing function to a certain extent. If a required sealing pressure is large, the number of the shield tail brushes 131 can be increased.

The mud discharge pipe 6 and the mud feed pipe 7 are both arranged in the shied body 1. An inlet of the mud discharge pipe 6 and an outlet of the mud feed pipe 7 are both in communication with the soil chamber 113. Two mud discharge pipes 6 are provided, and inlets of the two mud discharge pipes 6 are both arranged adjacent to the bottom of the soil chamber 113, and the two auxiliary cutterheads 3 are arranged adjacent to the inlets of the two mud discharge pipes 6 respectively.

During tunneling by means of the tunnel boring machine 100, a main body portion of the tunnel boring machine 100 is mainly pushed forwards by means of the thrusting cylinders 4. The tunnel boring machine 100 moves ahead, in the meantime, the first drive mechanism 23 drives the main cutterhead 2 to rotate, and the main cutterhead 2 has a circular excavation face. At the same time, the first drive mechanism 23 is driven by the third drive mechanism 24 to reciprocate up and down under the cooperative guidance of the sliding block and the sliding rail 112, such that the main cutterhead 2 is driven to reciprocate up and down. The main cutterhead 2 has an excavation face having two semicircular ends and a rectangular middle portion, under the composite action of rotation and up-down reciprocation.

During rotation and up-down reciprocation of the main cutterhead 2, the lubricating channel 2522 of the rotary sealing member 252 and the lubricating channel 2512 of the translational sealing member 251 are filled with the sealing oil. Because of unidirectional property of the kind of seal lip, the oil is continuously pressed into the soil chamber 113, thereby ensuring the sealing performance of the soil chamber 113. During up-down reciprocation of the main cutterhead 2, the scrapping member 253 mounted on the translational sealing plate 25 moves along with the first drive mechanism 23, and contact the mud, soil and the like on a sealing face of the separating plate 111 in advance, such that the mud and soil on the sealing face can be scrapped and cleaned, thereby preventing the translational sealing member 251 from contacting the soil and prolonging the service life of the translational sealing member 251. In the meantime, because the scrapping member 253 is made of elastic material and compressive deformation to some extent is reserved during installation, the scrapping member 253 can compensate automatically in case of wearing, such that the scrapping member 253 can always abut against the sealing face and scrap and clean the sealing face.

Two second drive mechanisms 31 drive the two auxiliary cutterheads 3 to rotate respectively, such that the auxiliary cutterheads 3 can cut the tunnel face which is not cut by means of the main cutterhead 2, thereby ensuring the whole excavation face of the tunnel boring machine 100 can be cut completely to form a standard horseshoe-shaped section. When large-size soil enters the soil chamber 113, the auxiliary cutterheads 3 can serve as a breaker to break the large-size soil, such that the soil can enter the mud discharge pipe 6 smoothly. If the auxiliary cutterheads 3 get stuck by rocks, an electric motor of the second drive mechanism 31 can rotate in a reverse direction to drive the auxiliary cutterheads 3 to rotate in a reverse direction to get rid of the dilemma.

The tunnel boring machine 100 tunnels, in the meantime, the mud feed pipe 7 continually conveys the mud which is filtered on the ground to the soil chamber 113, such that the mud in the soil chamber 113 is relatively stable in density, thereby facilitating output of the mud. The mud discharge pipe 6 continually conveys the mud in the soil chamber 113 to the ground for filtering, thereby ensuring that the tunnel boring machine 100 normally tunnels. In order to ensure that the pressure on the mud in the soil chamber 113 and the excavation face are stable, a certain relation is ensured between flows of the mud feed pipe 7 and the mud discharge pipe 6. Sealing oil in the shield tail enters the two sealing chambers 132 defined by the three shield tail brushes 131 through a pipe pre-embedded in a housing of the tail shield 13. During tunneling by means of the tunnel boring machine 100, the two sealing chambers 132 are filled with the sealing oil, such that the mud at a back of a segment and the mud in the soil chamber 132 cannot enter an interior of the shield body 1, thereby ensuring a stable pressure of the whole tunnel boring machine 100.

When a forward distance of the tunnel boring machine 100 is larger than a width of the segment, the segments can be erected. During erecting the segments, the tunnel boring machine does not tunnel. The segment erector 5 can accurately position and mount the segments by grapping, locking, lifting, translating, rotating, slightly adjusting corresponding segments and the like process steps. During erecting the segments, the trusting cylinders 4 in an erecting area draw back to facilitate operation of the segment erector 5, and the trusting cylinders 4 in a non-erecting area tightly abut against end faces of segments which are erected already, to prevent the tunnel boring machine 100 from retreating until that segments of a ring are completely erected and the tunnel boring machine 100 enters a next tunneling and erecting cycle.

Reference throughout this specification to "an embodiment," "some embodiments," "illustrative embodiment", "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from principles and scope of the present disclosure.

What is claimed is:

1. A tunnel boring machine, comprising:

a shield body;

a cutterhead assembly, comprising a main cutterhead and a plurality of auxiliary cutterheads, the main cutterhead being rotatably arranged at a front side of the shield body and defining a soil chamber between the main cutterhead and the shield body, the main cutterhead being movable along an up-down direction, the plurality of auxiliary cutterheads being rotatably arranged in the soil chamber, the plurality of auxiliary cutterheads being adjacent to a bottom of the shield body and arranged at a left side and a right side of a vertical central line of the main cutterhead, a rotation diameter of the main cutterhead is greater than a rotation diameter of the auxiliary cutterhead, and the rotation diameter of the main cutterhead is the same as a maximum width of the shield body;

a first drive mechanism configured to drive the main cutterhead to rotate;

a second drive mechanism configured to drive the auxiliary cutterheads to rotate; and a third drive mechanism configured to drive the main cutterhead to move up and down;

wherein the shield body is provided with a separating plate therein, the soil chamber is defined among the shield body, the separating plate and the main cutterhead, the first drive mechanism is arranged in the shield body and located behind the separating plate, the first drive mechanism penetrates the separating plate and is connected to the main cutterhead, and the third drive mechanism is connected to the first drive mechanism;

wherein the first drive mechanism is provided with a translational sealing plate, and the translational sealing plate surrounds a periphery of the first drive mechanism, the translational sealing plate is located in the soil chamber and adjacent to the separating plate;

wherein a seal ring is arranged between an inner circumferential wall of the translational sealing plate and an outer circumferential wall of the first drive mechanism.

2. The tunnel boring machine according to claim 1, wherein two auxiliary cutterheads are provided and arranged at the left side and the right side of the vertical central line of the main cutterhead correspondingly, one of the auxiliary cutterheads is adjacent to a left side wall of the shield body, and the other one of the auxiliary cutterheads is adjacent to a right side wall of the shield body.

3. The tunnel boring machine according to claim 1, wherein the translational sealing plate has a surface facing the separating plate, and the surface is provided with a translational sealing member configured to seal a gap between the separating plate and the translational sealing plate.

4. The tunnel boring machine according to claim 3, wherein the translational sealing member is a lip seal, the lip seal has a plurality of lip portions spaced apart from each other, and a lubricating channel is defined between two adjacent lip portions.

5. The tunnel boring machine according to claim 3, wherein the surface of the translational sealing plate facing the separating plate is provided with a scrapping member, the scrapping member has a free end, the free end abuts against a surface of the separating plate facing the soil chamber, and the scrapping member is located at an outer side of the translational sealing member in a radial direction.

6. The tunnel boring machine according to claim 5, wherein the scrapping member comprises a fixed portion and a scrapping portion, the fixed portion is connected to the translational sealing plate, an end of the scrapping portion is connected to the fixed portion, the other end of the scrapping portion abuts against the surface of the separating plate facing the soil chamber, and the other end of the scrapping portion obliquely extends from the translational sealing plate to the separating plate along a direction away from a center of the translational sealing plate.

7. The tunnel boring machine according to claim 6, wherein the scrapping portion is an elastic member in a state of compression.

8. The tunnel boring machine according to claim 1, further comprising a flange and a plurality of support legs, an end of each support leg is connected to the main cutterhead, the other end of each support leg is connected to the flange, the flange is rotatably connected to the first drive mechanism and located at a side of the translational sealing plate facing the soil chamber, a surface of the translational sealing plate facing the flange is provided with a rotary sealing member, and the rotary sealing member is configured to seal a gap between the flange and the translational sealing plate.

9. The tunnel boring machine according to claim 8, wherein the rotary sealing member is a lip seal, the lip seal has a plurality of lip portions spaced apart from each other, and a lubricating channel is defined between two adjacent lip portions.

10. The tunnel boring machine according to claim 1, wherein the third drive mechanism is provided with a displacement sensor configured to detect a displacement of the first drive mechanism.

11. The tunnel boring machine according to claim 1, further comprising a mud discharge pipe and a mud feed pipe, an inlet of the mud discharge pipe and an outlet of the mud feed pipe are both in communication with the soil chamber, and at least one auxiliary cutterhead is adjacent to the inlet of the mud discharge pipe.

12. The tunnel boring machine according to claim 1, wherein the separating plate is provided with a sliding rail extending along the up-down direction, and the first drive mechanism is provided with a sliding block suitable for sliding along the sliding rail.

13. The tunnel boring machine according to claim 2, wherein the separating plate is provided with a sliding rail extending along the up-down direction, and the first drive mechanism is provided with a sliding block suitable for sliding along the sliding rail.

14. The tunnel boring machine according to claim 3, wherein the separating plate is provided with a sliding rail extending along the up-down direction, and the first drive mechanism is provided with a sliding block suitable for sliding along the sliding rail.

* * * * *